United States Patent [19]

Manly, Jr.

[11] Patent Number: 4,464,891

[45] Date of Patent: Aug. 14, 1984

[54] YARN PROCESSING MACHINE AND CREEL ASSEMBLY

[76] Inventor: W. Judson Manly, Jr., 902 Olive Way, Dalton, Ga. 30720

[21] Appl. No.: 31,019

[22] Filed: Apr. 17, 1979

[51] Int. Cl.[3] ..... B65H 49/16; D01H 13/04

[52] U.S. Cl. ..... 57/90; 57/1 R; 57/75; 242/131

[58] Field of Search ..... 57/90, 75, 352, 1 R; 242/131, 131.1, 130

[56] References Cited

U.S. PATENT DOCUMENTS

| | | | |
|---|---|---|---|
| 1,003,026 | 9/1911 | Bartmann | 242/131 |
| 1,180,284 | 4/1916 | Cook | 242/131 |
| 2,209,203 | 7/1940 | Kahlisch | 242/131.1 |
| 3,304,026 | 2/1967 | Bucklow et al. | 242/131 |
| 4,163,357 | 8/1979 | Greive et al. | 57/352 X |
| 4,175,717 | 11/1979 | Mathiolon et al. | 242/131 |
| 4,240,594 | 12/1980 | David, Jr. | 57/90 X |

FOREIGN PATENT DOCUMENTS

| | | | |
|---|---|---|---|
| 1344830 | 10/1963 | France | 242/131 |
| 1442394 | 5/1966 | France | 242/131 |

*Primary Examiner*—John Petrakes
*Attorney, Agent, or Firm*—Jones & Askew

[57] ABSTRACT

A combination yarn processing machine and overhead creel assembly comprising a machine mounted overhead creel assembly including a bobbin carriage which pivots about an axis mounted on a framework above the yarn processing machine. The bobbin carriage pivots through a circular arc between an up position substantially above and over the processing machine and a down position substantially above and beside the machine without substantially changing the length of the yarn extending between creel bobbins or other yarn packages in the bobbin carriage and the processing machine and is loaded and unloaded to replace empty yarn packages while the processing machine is in operation drawing yarn from still laden yarn packages on the same bobbin carriage. A spring loaded counterbalancing system holds the bobbin carriage in the up position and in the down position and aids in minimizing the effort expended by operators servicing the machine while moving the bobbin carriage between the up and down position.

10 Claims, 5 Drawing Figures

YARN PROCESSING MACHINE AND CREEL ASSEMBLY

BACKGROUND OF THE INVENTION

This invention relates generally to a creel used to hold yarn packages to be consumed by yarn processing machines, and more specifically to a machine mounted overhead creel carrying bobbins of yarn to be used in conjunction with a ring twister.

Ring twisters are generally used in the textile industry to impart twist in yarn taken off a first yarn package and to repackage the yarn on a second yarn package, or bobbin. The second package, or twister bobbin, is held by the twister machine in a vertical orientation on a twister spindle below twister pull rolls and the yarn is fed from the first yarn packages into the machine through the pull rolls generally from overhead. In a typical ring twister, there are approximately 50 spindles mounted on each of two sides of the twister for a total of 100 spindles, and twister bobbins. A separate bank of twister pull rolls feeds yarn to the twister bobbins on each side of the machine. The first packages, which may include yarn wrapped on, for example, bobbins or tubes, are held by a structure known as a creel. For purposes of this disclosure, the first yarn package is hereinafter referred to as a creel bobbin.

It is generally the function of a twisting machine to twist together two or three plies of yarn to form a single yarn wound onto each twister bobbin. A creel must carry at least one creel bobbin for each ply twisted onto each twister bobbin. For simplicity, the following specification shall be in terms of the production of two ply yarn, but it will be understood that the invention may be embodied in the production of yarn of more than two plies (or only one end). Therefore, for each two ply yarn produced on one twister bobbin, yarn must be fed to the twister machine from two separate creel bobbins. For many years, the two yarn supply bobbins were positioned on a yarn stand or creel mounted above the yarn processing machine, one supply bobbin for each ply. When one creel bobbin ran out of yarn, the spindle had to be disengaged and the empty bobbin replaced by a full one. Therefore, the ring twister spindles were constantly being disengaged to replace bobbins.

In an effort to minimize the number of spindle shut downs, it has become common practice in the trade to tie or splice a reserve creel bobbin to each of the original, or supply, creel bobbins. The lead end of the reserve bobbin is tied to the tail end of the supply bobbin in order that, as the supply bobbin runs out of yarn, the reserve bobbin immediately begins feeding yarn to the twister. While the reserve bobbin is feeding yarn, the original supply bobbin is replaced by yet another full creel bobbin and the lead end of this third creel bobbin is spliced to the tail end of the reserve bobbin. When reserve creel bobbins are utilized in the production of two-ply yarn, the creel must carry four creel bobbins for each twister bobbin.

As the number of yarn supply bobbins carried by the creel increased, it became difficult to accommodate the necessary number of bobbins on a machine mounted creel without positioning some of the bobbins high above the yarn processing machine where ready access was impaired. Therefore, creel design has centered around the need for a creel which can hold the great number of creel bobbins necessary and keep these bobbins in a readily accessible position.

Typically floor standing side creels have been developed by the industry to hold a large number of bobbins in close proximity to the floor for easy access. See for example U.S. Pat. No. 3,674,223. However, the need for increased production of yarns has pressed manufacturers to purchase more processing machines and to make room in their plants for these new machines. In an effort to find added space for the new machines, new ways have been sought to get the creel off the floor and back above the machine.

The machine mounted creels must provide for easy access to the creel bobbins by an operator in order that the creel can be loaded and unloaded with reserve bobbins and spliced without affecting the continued operation of the machine. An operator must get to every station along the twister machine, that is, one station for each of the approximately 100 spindles, before the yarn runs out, and unload, load and splice each of the empty creel bobbins. If the operator moves too slow and misses one station, that spindle must be shut down and the yarn rethreaded, thus lessening the efficiency of the machine.

While loading and unloading the creel bobbins, it is important that the flow of yarn from the creel bobbins to the twister machine not be interrupted and furthermore, that the length of the yarn moving to the ring twister not be substantially changed. If the yarn is allowed to slacken or stretch by any substantial amount, yarn loops or breaks can result in the yarn feeding to the twister bobbins.

It is, therefore, desirable to provide a creel which an be quickly serviced with a minimum of energy expended by the operator while maintaining continuous satisfactory operation of the yarn processing machine.

SUMMARY OF THE INVENTION

Briefly described, the present invention comprises an overhead creel assembly mounted above a ring twister or other yarn processing machine. The overhead creel assembly includes a plurality of arcuate shaped creel arms, each of which swings in a circular arc above the twister machine about an axis located above the creel arm. Each creel arm, one for each twister spindle, swings from an up position over the twister to a down position above and beside the twister. Each creel arm carries the required number of creel bobbins for one twister bobbin, for example, four creel bobbins to provide a two-ply yarn on the twister bobbin. Creel bobbins are loaded, unloaded and otherwise serviced with the creel arm in the down position. The creel assembly further includes yarn guides to guide the yarn through a certain path to the twister pull rolls in order that the length of the yarn undergoes only negligible change when the creel arm is in the up position, down position, or anywhere in between. In this way, the twiser can remain running at all times, with the creel arm in any position, with little fear of the yarn slackening or stretching to cause breakage or loops in the yarn during servicing of the creel bobbins.

The creel assembly further includes a spring loaded counterbalancing system which draws the creel arm into its up position. The counterbalancing system includes an overcenter linkage functioning as a locking mechanism which directs the spring forces of the counterbalancing system so as to hold the creel arm in the down position without the need for latching type lock down devices. The design of the creel arm and counterbalancing system is such that the spring forces are easily overcome by an operator utilizing a minimum of effort to thus pull the creel arm from the top position to the down position or to push the creel arm to overcome the overcenter linkage and return the creel arm to its up position.

It is therefore an object of the present invention to provide a yarn processing machine and machine-mounted, overhead creel assembly which provides ready access to a large quantity of creel bobbins.

Another object of the present invention is to provide a machine-mounted, overhead creel assembly for carrying a plurality of creel bobbins which can be loaded and unloaded quickly and with a minimum of effort on the part of the operator.

Yet another object of the present invention is to provide a machine mounted overhead creel which carries bobbins which can be alternately positioned either in an up position over the machine or in a down position above and beside the machine from which the bobbins can be serviced by pivoting the bobbins through an arcuate path of constant radius about a horizontal axis located above the bobbins and which maintains an approximately constant yarn length from the creel bobbins to the yarn processing machine while changing the bobbins between the up and down positions.

Still another object of the present invention is to provide a machine mounted overhead creel which includes a creel arm pivotable between an up and down position and includes a spring loaded counterbalancing system and overcenter linkage for holding the creel arm alternately in the up or down position.

Other objects, features and advantages of the present invention will become apparent upon reading and understanding the remaining specification, when taken in conjunction with the accompanying drawings.

DETAILED DESCRIPTION

Figure 1:
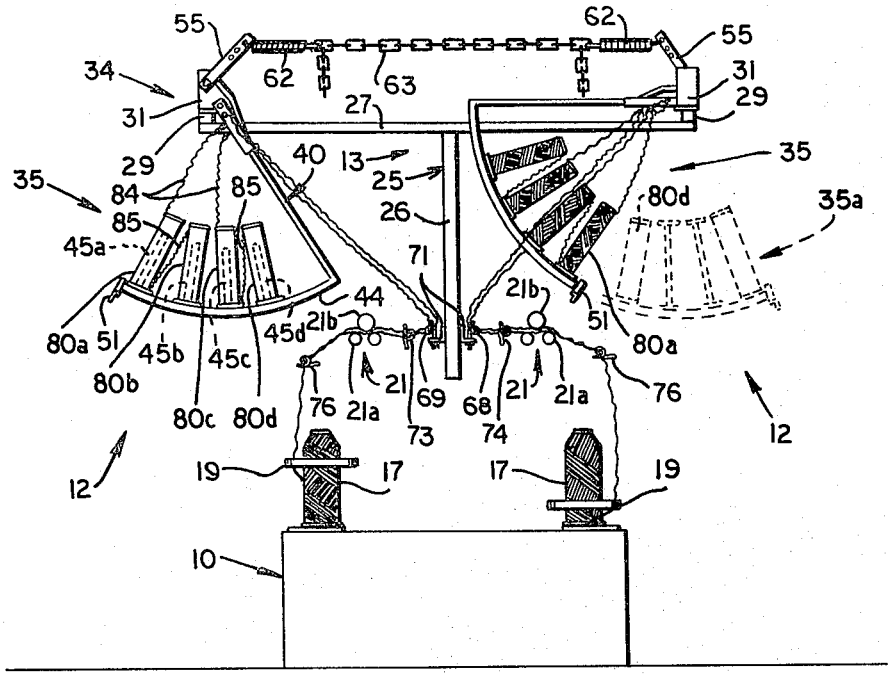
FIG. 1 is an end view of a combination ring twister and machine mounted overhead creel in accordance with the present invention.
Figure 2:
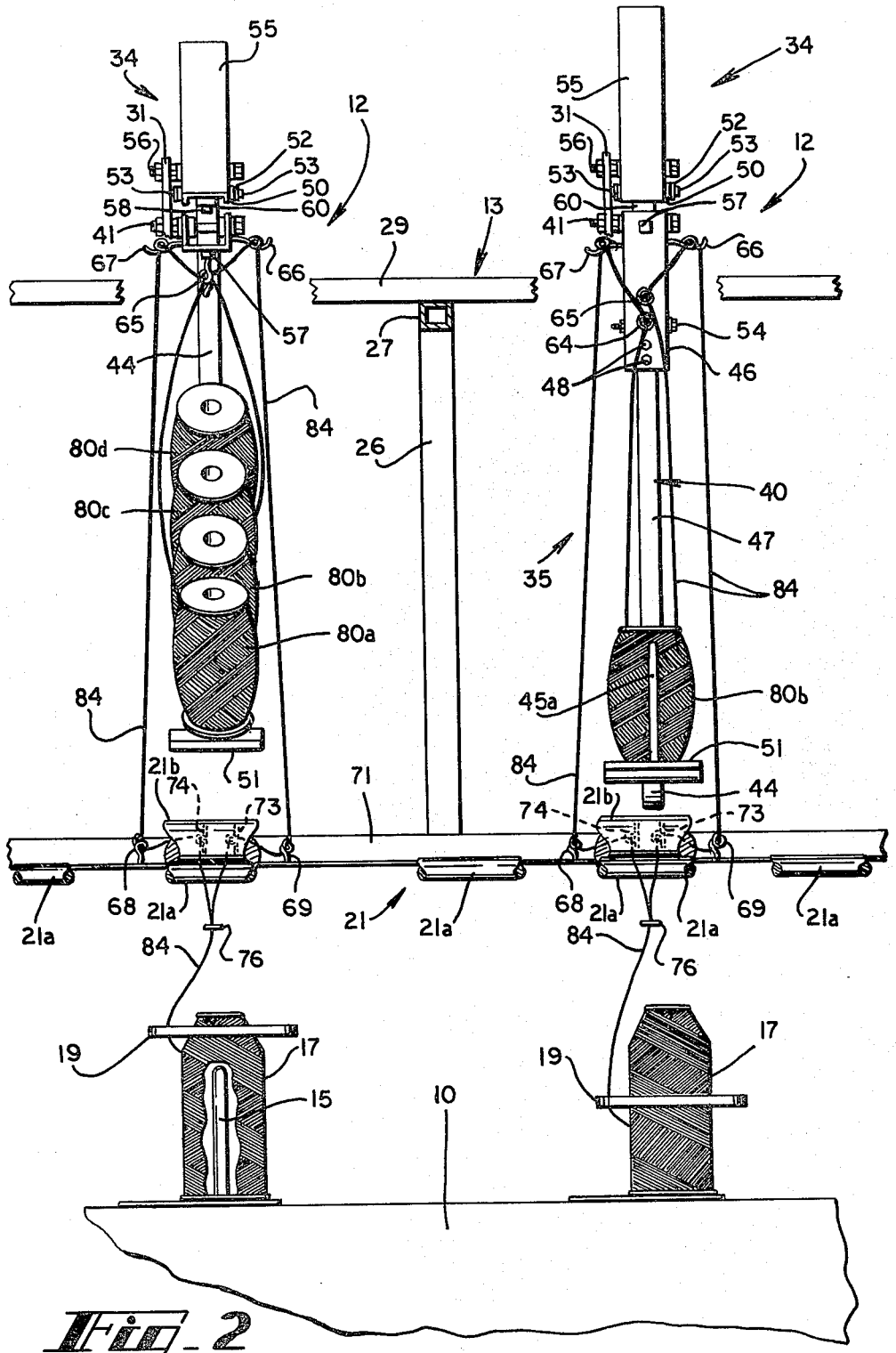
FIG. 2 is a partial front view of the combination in FIG. 1 with parts broken away.

Referring now in greater detail to the drawings in which like numerals represent like components throughout the several views, FIGS. 1 and 2 show a combination in accordance with the present invention of a yarn processing machine 10, shown here as a ring twister 10, and a plurality of creel assemblies 12 supported over the ring twister by a creel support framework 13 mounted on top of the twister. The ring twister 10 comprises a row of twister spindles 15 mounted on each of two opposite sides of the machine and twister bobbins 17 removably mounted on each of the spindles. A ring follower is schematically represented at 19. A bank of three elongated twister pull rolls 21 extends along each side of the machine above the spindles 15. At least one of the lower pull rolls **21*a* is driven continuously from the end of the machine 10. The upper roll 21*b* is a short pivoted roll above each spindle 15 which can be individually raised to stop the yarn feed to that particular spindle. Each spindle 15** has a spindle clutch (not shown) which is used to disengage that spindle without affecting the other spindles.

The creel support framework 13 comprises a plurality of T-shaped braces 25 (only one of which is shown) mounted on top of the ring twister 10 and spaced apart at intervals along the length of the twister. Each brace 25 includes a vertical leg 26 and horizontal leg 27. At each end of the horizontal leg 27 is attached a horizontal support bar 29 extending perpendicular to the horizontal leg 27 and connecting adjacent braces 25. Although it is generally the case that there will be a plurality of twister spindles 15 on two sides of a typical twisting machine 10 and therefore a plurality of creel assemblies 12, one creel assembly for each twister spindle, the present invention is not to be so limited as it is within the scope and spirit of this invention to provide a single creel assembly or a row of creel assemblies on only one side of the twisting machine if such an arrangement is desired.

Each creel assembly 12 is attached to the support framework 13 by a bracket 31 which is mounted on top of the support bar 29 by bolting, welding or otherwise. Connected to a vertically oriented plate 32 of each bracket 31 are a spring loaded counterbalancing system 34 and a creel arm assembly 35. There is provided one creel assembly 12 corresponding to each and every twister spindle 15. It is within the scope of this invention to provide other embodiments which carry yarn packages to serve two or more spindles 15 on one creel arm assembly 35 and have one creel assembly 12 for every two or more spindles.

The creel arm assembly 35 comprises a swinging bar 40 which pivots about a bolt 41, representing a horizontal axis, by which the swinging bar 40 is attached at one of its ends to the bracket plate 32. The other end of the swinging bar 40 is connected to an arcuate creel arm 44 on which are mounted four creel bobbin pins **45*a*–45*d*. Preferably, as seen in the drawings, the creel arm comprises a circular arc including a radius of curvature equal to the length of the swinging bar 40 from the axis bolt 41 to the creel arm 44, in order that the creel arm 44 defines an arc of the path through which it pivots. The creel arm 44 can carry more or less creel bobbin pins 45 if desired. In the preferred embodiment shown, the swinging bar 40 includes two sections of bar 46, 47. The lower section 47 of the swinging bar 40 is generally rectilinear with one end connected to the creel arm 44 and the other end attached to the upper swing bar section 46 by two bolts 48. In the preferred embodiment, the lower section 47 of the swinging bar 40 and the creel arm 44 are bent from one continuous piece of tubing, although the invention is not to be so limited. The upper section 46 of the swinging bar 40, which is U-shaped in profile and partly surrounds the lower section 47, is attached at its end opposite the lower section 47 to the axis bolt 41 and is fit with bushings 50 between the upper section 46 and the axis bolt 41. A handle 51 is defined at the outer end of the creel arm 44, that is, the end opposite the swinging bar 40**.

Figure 3:
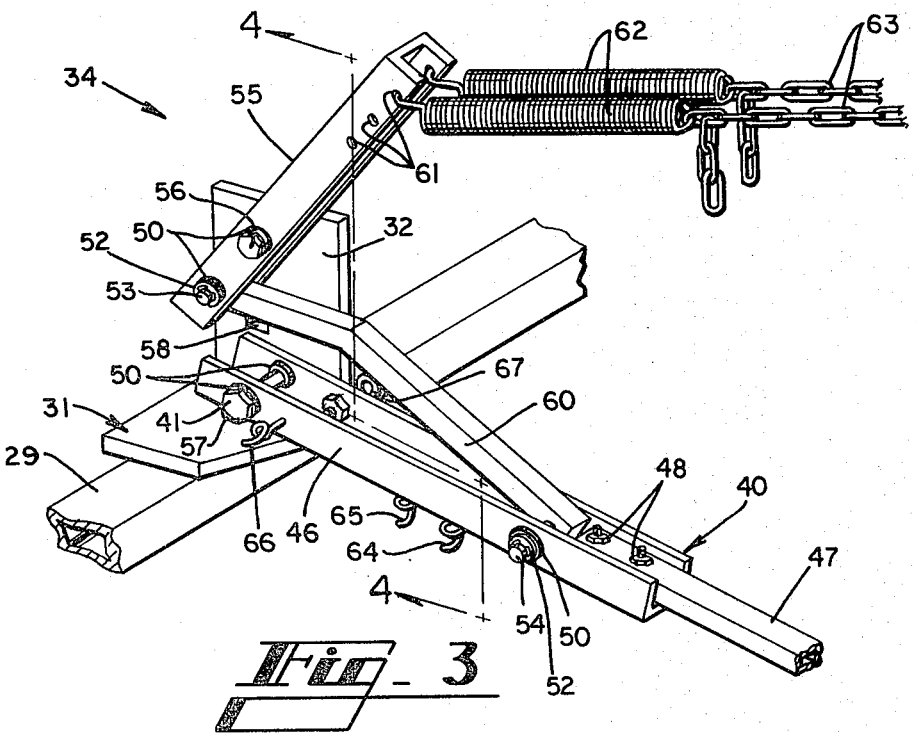
FIG. 3 is an isolated pictorial view of the spring loaded counterbalancing system of the combination in FIG. 1 showing the creel arm in the up position.
Figure 4:
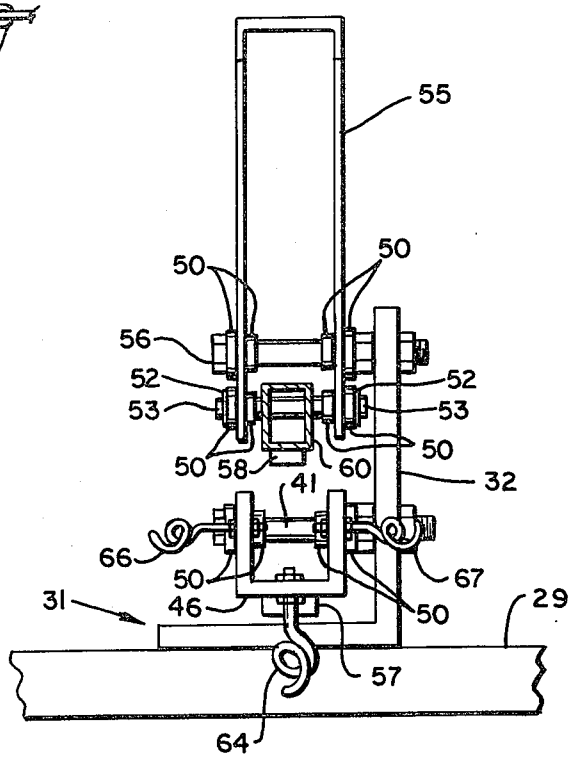
FIG. 4 is an isolated view of the spring loaded counterbalancing system of the present invention taken along line 4—4 of FIG. 3.
Figure 5:
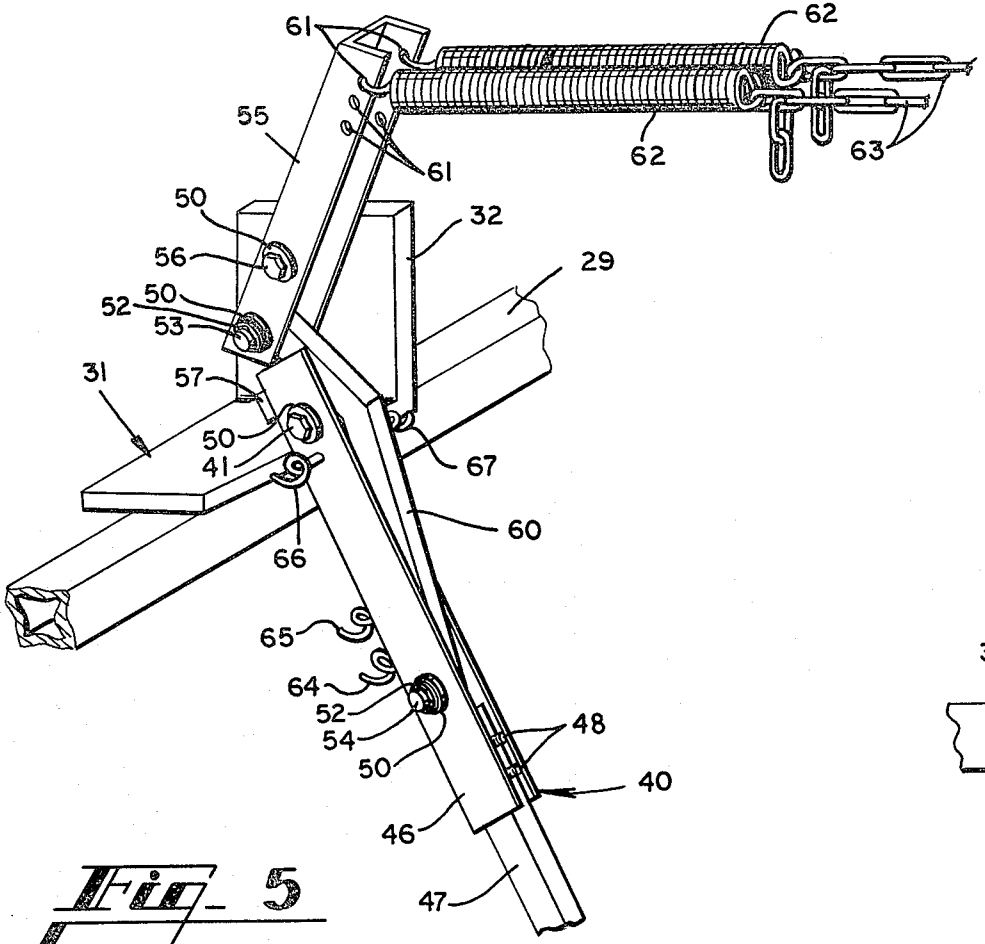
FIG. 5 is an isolated pictorial view of the spring loaded counterbalancing system of the combination in FIG. 1 showing the creel arm in the down position.

The spring-loaded counterbalancing system 34, seen best in FIGS. 3–5, comprises a rocker 55 mounted, intermediate its two ends, by a bolt 56 to the vertical bracket plate 32 above the swinging bar 40. The rocker 55 is pivotable about the bolt 56 and the connection between the rocker 55 and bolt 56 is fit with bushings 50. Spring connecting holes 61 are formed in the upper end of the rocker 55. An "over center" linkage 60 connects the lower end of the rocker 55 to the upper section 46 of the swinging bar 40. That is, the linkage 60 is connected at one of its ends to the rocker 55 by a pin 53 and is connected at the other of its ends to the swinging bar 40 by a pin 54. The pins 53, 54 act as pivot points between the respective links. Snap rings 52 on each side of both pins 53, 54 hold the pins in place. The connections between the linkage 60 and both rocker 55 and bar 40 are fit with bushings 50 about the pins 53, 54. The linkage 60 is curved downward as shown. Two counterbalance springs 62 are connected through two of the spring connecting holes 61 to the rocker 55, and the upper end of the rocker 55 is connected by the counter balance springs 62 and chains 63 to the upper end of a similar rocker **55*b* of an identical counterbalance system and creel arm assembly mounted on the opposite support bar 29 of the framework 13. The disclosed embodiment shows the use of two chains 63, each with a spring 62 at both of its ends. It is within the scope of this invention to replace at least a portion of each chain with a hooked rod. If it is desired to have only one creel assembly 12 or only one row of creel assemblies 12 on one side of the twister 10, the chains 63 of the counterbalance system are attached to a stationary brace (not shown) replacing the rocker 55 of the second creel assembly 12. A first bumper 57 is attached to the bottom surface of the swinging bar 40 at the end of the upper swinging bar section 46 adjacent the axis bolt 41. A second bumper 58 is attached to the bottom surface of the overcenter linkage 60 at the end of the linkage adjacent the rocker 55**.

First yarn guides 64, 65 are attached to the swinging bar 40 spaced apart at points above the creel bobbins 80, and upper yarn guides 66, 67 are attached to the swinging bar 40 at or near the axis bolt 41. There is one first yarn guide 64, 65 and one upper yarn guide 66, 67 for each two creel bobbin pins 45 on the creel arm 44. Lower yarn guides 68, 69, associated with each creel assembly 12 and of the same number as upper guides 66, 67, are attached to elongated brackets 71 (see FIG. 2) extending from the vertical legs 26 of the T-shaped braces 25 parallel to and in approximately the same horizontal plane as the twister pull rolls 21. Pull roll yarn guides 73, 74 (shown in FIG. 1 and by dotted lines in FIG. 2) are located adjacent and behind the pull rolls 21 and a single front yarn guide 76 is located adjacent and in front of the pull rolls 21. Although the yarn guides 64–69 are shown here as being pigtail guides, other known guides can be used. In alternate embodiments of the present invention, tensioning devices replace certain of the pigtail yarn devices, preferably replacing either the upper guides 66, 67 or the lower guides 68, 69.

In operation, the creel arm assembly 35 swings, pivoting about the axis bolt 41, through a circular path from an up position (as shown by the right hand creel assembly of FIG. 1) where the creel arm 44 is located substantially over the twister 10 to a down position (shown by the left hand creel assembly of FIG. 1) where the creel arm 44 is located substantially above and beside the twister. In accordance with the preferred embodiment shown herein, the creel arm 44 defines the lowermost arc of its arcuate path of movement when the assembly is in the down position. Although the disclosed embodiment shows the creel arm 44 in the down position located "above" the twister machine 10, the horizontal leg 27 and thus the axis bolt 41 can be lowered (i.e., by shortening vertical leg 26) such that the creel arm, in the down position, is located at least partially below the twister pull rolls 21. Furthermore, by varying the length of the horizontal leg 27, the relative positioning of the creel arm assembly 35 "over" and "beside" the twister machine 10 can be varied in accordance with design choice. The creel arm 44 must swing past the twister pull rolls 21, without hitting the pull rolls, while pivoting between the up and down positions, and this constraint limits positioning of the creel arm 44 and creel arm assembly 35 relative to the twister machine 10 and twister pull rolls.

The counterbalance system 34 functions as a means for holding the creel arm 44 in either the up position or the down position and for controlling the speed of movement of the creel arm 44 through its circular path. As indicated by the "phantom" lines in FIG. 1, it is preferable that there is sufficient clearance between the rear creel bobbin **80*d* of a creel arm assembly 35*a* in the down position and the front creel bobbin 80*a* of an adjacent creel arm assembly 35** in the up position to allow an operator to service one creel arm assembly without interferring with the adjacent creel arm assembly.

The creel arm assembly 35 functions as a carriage for the creel bobbins **80*a*–80*d*, and with the creel arm 44 in the down position, creel bobbins 80*a*–80*d*, full of yarn 84, are loaded onto the bobbin pins 45*a*–45*d*. The creel bobbins 80*a*–80*d* are connected together in pairs 80*a*–80*b* and 80*c*–80*d* by tying or splicing the tail end of the yarn on a first bobbin 80*a*, 80*c* in each pair to the lead end of the yarn on the second or reserve bobbin 80*b*, 80*d* in the pair. This splicing is represented by yarn section 85. The leading end of the yarn 84 from the first bobbin 80*a* of the first pair of bobbins 80*a*–80*b* is threaded (see FIG. 2) through first yarn guide 65, then through the corresponding upper yarn guide 66, lower yarn guide 69 and pull roll yarn guide 73, through the twister pull rolls 21, front yarn guide 76 and ring 19 to the twister bobbin 17. The leading end of the yarn 84 from the first bobbin 80*c* of the second pair of bobbins 80*c*–80*d* is threaded through first yarn guide 64, then through the corresponding upper yarn guide 67, lower yarn guide 68 and pull roll yarn guide 74, through the pull rolls 21, front yarn guide 76 and ring device 19 where the yarn is twisted with the yarn from the first pair of bobbins 80*a*–80*b* onto the twister bobbin 17. The positioning of the yarn guides 65, 66, 69 and 64, 67, 68 directs the yarn 84 from each of the bobbin pairs 80*a*–80*b*, 80*c*–80*d* along opposite sides of the creel arm 44** to aid in preventing enganglement of the yarns.

Once loading of creel bobbins 80 onto the creel arm 44 is complete and the yarn 84 has been threaded, the operator returns the creel arm 44 to its up position by pushing "in" gently on the creel handle 51 with a mostly lateral motion. Yarn is drawn from the creel bobbins 80 during operation of the ring twister 10 and as the first bobbins **80*a*, 80*c* of each pair become empty, the reserve bobbins 80*b*, 80*d* begin automatically feeding yarn to the twister by virtue of the splicing 85. Empty creel bobbins may be replaced with full bobbins while the twister 10 is still operating and drawing yarn from the still laden reserve bobbins. To replace empty bobbins, the operator grasps the creel handle 51 and pulls to swing the creel arm 44** through the circular arc from the up position to the down position.

In the down position, the creel arm 44 is supported from the support bar 29 and axis bolt 41 with the creel arm 44 preferably located at the lowermost arc portion of the circular path through which the creel arm moves while pivoting about the axis pin for ease of access by the operator. While in the down position, the two empty creel bobbins 80*a*, 80*c* are removed from the creel bobbin pins 45*a*, 45*c*, and replaced with full bobbins and the four bobbins are again spliced together in pairs.

The path along which the yarn 84 travels from each creel bobbin 80 through the yarn guides 65, 66, 69 or 64, 67, 68 and the twister pull rolls 21 remains substantially the same length in each and every position traveled by the creel arm 44 through its accurate path from and including the up position to and including the down position. In the disclosed embodiment, this substantially constant path length is made possible by positioning the upper yarn guides 66, 67 near to the axis bolt 41 in order that the upper yarn guides move as little as possible relative to the axis bolt as the creel assembly pivots through its circular arc. That is, in the disclosed embodiment, the upper yarn guides 66, 67 move through the smallest possible arc as the swinging arm 40 pivots about the axis pin. The smaller the arc through which the upper guides 66, 67 move, the less variance there is in the yarn length (or yarn path) between the upper guides and the lower yarn guides 68, 69. In another embodiment (not shown) of the invention, the upper yarn guides 66, 67, or tension devices, are mounted on a stationary part of the creel structure such as the vertical bracket 31 or the support bar 29. In that embodiment also, the upper guides, or tension devices 66, 67, are placed as near to the axis bolt 41 as possible in order that the distance along the yarn path from the creel bobbin to the upper guides varies only a negligible amount as the creel arm 44 and bobbins are pivoted about the axis bolt.

Once reloading is completed, the creel arm 44 is returned to the up position, the ring twister having been, and continuing at all times, to operate and consume yarn from the creel bobbins 80.

The spring loaded counterbalance system 34 functions to maintain the creel arm assembly 35 in both the up position and the down position without the use of hooks or latches. The springs 62 continually exert a spring force to pull on the upper section of the rocker 55 and to thus pivot the rocker, which acts as a lever 55, about the bolt 56 functioning as a pivot point or fulcrum 56. The linkage 60 is connected to the lever 55 at the opposite side of the fulcrum 56 from the springs 62 and, therefore, the linkage 60 is pulled upon by the rocker, or lever 55. The linkage 60 in turn pulls on the swinging arm 40. The springs 62, acting through the rocker 55 and overcenter linkage 60, exert sufficient force to overcome, or at least balance, the weight of the creel arm assembly 35 with full creel bobbins 80 loaded on the arm 44. Preferably, the spring force overcomes the weight at least slightly. In this way, the spring force will slowly draw the creel arm assembly 35 into the up position and hold it there. As the creel arm 44 is pulled by an operator toward the down position, the force exerted by the counterbalance system 34 continues to resist movement of the creel arm assembly 35 away from the up position. Furthermore, as the creel arm 44 is pulled by an operator toward the down position, the counterbalancing leverage from the counterbalancing system 34 imparted to the creel arm assembly 35 diminishes as the need for a counterbalance diminishes from the up position. Since the spring forces are preferably designed to only slightly overcome the weight of the creel arm assembly, it is intended that a minimum amount of force is required by the operator to pull the assembly downward. When the creel arm assembly 35 has reached the down position, the overcenter linkage 60 of the counterbalance system has gone "overcenter" to change to a mode where the spring force is pulling the creel arm assembly 35 away from the up position. The linkage 60 goes "overcenter", when the point of force between the linkage 60 and swing arm 40, represented by pin 54, passes beyond a line drawn through the point at which the spring force acts on the linkage 60 and the point about which the swing arm pivots, that is, a line through pin 53 and bolt 41. The counterbalancing link arrangement functions as a down end stop to stop movement of the assembly 35 in the down position. The bumper 58 aids in softening the stop of the creel arm assembly in the down position. Thus, the spring force in the overcenter mode, in cooperation with the down end stop, holds the creel arm assembly in its down position. To return the creel arm assembly 35 to the up position, the operator pushes the creel arm 44 until the overcenter linkage 60 goes back overcenter at which point the spring force again aids in returning the arm assembly 35 to the up position. As the creel arm assembly 35 reaches its uppermost position, the first bumper 57 aids in cushioning the stop. The spring tension and, therefore, spring force exerted on the rocker 55 is adjustable by hooking the spring 62 into different links of the chain 63. Tension can also be adjusted by hooking the spring 62 in different ones of the spring connecting holes 61.

Whereas the preferred embodiment, as previously disclosed, includes two sets of springs 62 and chains 63, it is noted that one of the sets of springs and chains also functions as a safety device in the event that a spring or chain of the other set breaks. Therefore, one set of springs and chains can be eliminated if desired. Likewise, the use of two counterbalance springs 62 with each chain 63, one on each side, is a matter of design choice.

Furthermore, whereas the present embodiment discloses the combination of a ring twister machine and an overhead creel, it will be understood that it is within the scope and spirit of the present invention to substitute for the ring twister, any other yarn processing machine which makes use of an accompanying creel.

While this invention has been described in detail with particular reference to preferred embodiments thereof, it will be understood that variations and modifications can be effected within the spirit and scope of the invention as described hereinbefore and as defined in the appended claims.

I claim:

1. Apparatus for holding a plurality of creel bobbins of yarn or other yarn packages for supplying yarn to a ring twister machine or like yarn processing machine, said apparatus comprising:

a bobbin carriage pivotable through a circular arc about a first stationary horizontal axis located above the processing machine, said bobbin carriage being pivotable between an up position above and substantially over the processing machine to a down position at least partly beside the processing machine;

and yarn guide means for guiding yarn from the yarn packages to twister pull rolls on the processing machine, said yarn guide means being positioned such that the length of the yarn path along which yarn must extend from each yarn package through said yarn guide means to the twister pull rolls with said carriage in its up position is approximately equal to the length of the yarn path from each yarn package through said yarn guide means to the twister pull rolls with said carriage in its down position, whereby there is little change in yarn path length with said bobbin carriage in said up position or in said down position or in any position between said up and down positions and thus the yarn processing machine can be operated to draw yarn from the yarn packages with said bobbin carriage in any position between and including said up and down positions; and counterbalancing means for holding said bobbin carriage in said up position and also in said down position, including a rocker pivotable about a second stationary horizontal axis;

a spring means attached at one of its ends to said rocker at a spring attachment point for exerting a spring force on said rocker at said spring attachment point; and an overcenter linkage attached at one of its ends to said bobbin carriage at a first hinge point and at its other end to said rocker at a second hinge point, said overcenter linkage being shaped so as to locate said first hinge point to one side of a line drawn between said second hinge point and said first stationary horizontal axis when said bobbin carriage is in said down position and to locate said first hinge point on the other side of said line when said carriage moves out of said down position, whereby said spring pulls on said rocker to pivot said rocker about said second horizontal axis thus pulling on said overcenter linkage to draw said bobbin carriage to said up position, and the pulling on said overcenter linkage by said rocker also holds said bobbin carriage in said down position.

2. Apparatus of claim 1 wherein said bobbin carriage comprises:

an arcuate creel arm radially disposed from said first stationary horizontal axis, said arcuate creel arm including a center of curvature located at said stationary horizontal axis;

a swinging bar connected at one of its ends to said creel arm and at its other end to said first stationary horizontal axis, said swinging bar being pivotable about said axis to pivot said creel arm through a circular arc about said axis; and a plurality of bobbin pins attached to said creel arm and protruding radially inward from said creel arm.

3. A combination ring twister machine or like yarn processing machine and overhead creel assembly for holding a plurality of creel bobbins of yarn or other yarn packages from which yarn can be drawn from the creel assembly into the twister machine, said combination comprising:

a yarn processing machine base structure;

creel structure positioned on top of said base structure;

a plurality of spindles located on each of two opposite sides of said base structure;

a pull roll assembly associated with said spindles;

a bobbin carriage including an arcuate creel arm associated with each of said spindles, each said creel arm being suspended from said creel structure by a swinging bar pivotable about a first stationary horizontal axis mounted to said creel structure, and each said creel arm being capable of holding a plurality of yarn packages, said bobbin carriage being movable through a circular arc about said horizontal axis as defined by the movement of said swinging bar from a first up position to a second down position;

spring biasing means for biasing said bobbin carriage toward said up position and for holding said bobbin carriage in said down position; and means for maintaining the length of the yarn path along which yarn must extend from yarn packages in said bobbin carriage to said pull roll assembly with said bobbin carriage in said up position approximately equal to the length of said yarn path with said bobbin carriage in said down position, whereby said pull rolls can be operated to draw yarn from the yarn packages with said carriage in any position between and including said up position and said down position; further provided that said biasing means include, a rocker pivotable about a second stationary horizontal axis positioned on said creel structure;

a link attached at one of its ends to said swinging bar at a first hinge point and at its other end to said rocker at a second hinge point, a spring means for attaching at one of its ends to said rocker at a spring attachment point, said second horizontal axis acting as a fulcrum relative to said spring attachment point and said second hinge point, whereby said spring means pulls continually said rocker to pivot said rocker about said second horizontal axis thus pulling on said link to draw said swinging bar upward and to thus draw said bobbin carriage to said up position.

4. Combination of claim 3 wherein said link is bent so as to locate said first hinge point to one side of a line drawn between said second hinge point and said first stationary horizontal axis when said bobbin carriage is in said down position and to locate said first hinge point on the other side of said line when said bobbin carriage moves out of said down position.

5. Combination of claim 3, wherein said means for maintaining the length of the yarn path comprises:

a first yarn guide mounted near said pull roll assembly; and a second yarn guide positioned approximately at said first stationary horizontal axis, said first yarn guide and said second yarn guide defining a yarn path therebetween, the length of said yarn path remaining approximately constant as said bobbin carriage moves between said up position and said down position, whereby there is little change in yarn path length as said carriage moves from said up position to said down position and thus said yarn processing machine can be operated to draw yarn from the yarn packages with said carriage in any position between and including said up position and said down position.

6. A creel assembly comprising:

a first stationary horizontal axis for mounting above a yarn processing machine;

a support framework for supporting said stationary axis above the yarn processing machine;

a creel arm assembly suspended from said first stationary horizontal axis and below said axis, said creel arm assembly being pivotable through a circular arc about said stationary axis;

yarn guide means disposed adjacent said first stationary horizontal axis for guiding yarn from said yarn packages to said yarn processing machine; and counterbalancing means for limiting the pivotable movement of said creel arm assembly to movement between an up position and a down position and for holding said creel arm assembly in said up position and also in said down position, including a rocker pivotable about a second stationary horizontal axis;

a spring means attached at one of its ends to said rocker at a spring attachment point for exerting a spring force on said rocker at said spring attachment point; and an overcenter linkage attached at one of its ends to said bobbin carriage at a first hinge point and at its other end to said rocker at a second hinge point, said overcenter linkage being shaped so as to locate said first hinge point to one side of a line drawn between said second hinge point and said first stationary horizontal axis when said bobbin carriage is in said down position and to locate said first hinge point on the other side of said line when said carriage moves out of said down position, whereby said spring pulls on said rocker to pivot said rocker about said second horizontal axis thus pulling on said overcenter linkage to draw said bobbin carriage to said up position, and the pulling on said overcenter linkage by said rocker also holds said bobbin carriage in said down position.

7. Creel assembly of claim 6 wherein said creel arm assembly comprises:

an arcuate creel arm radially disposed from said first stationary horizontal axis, said arcuate creel arm including a center of curvature located at said stationary horizontal axis;

a swinging bar connected at one of its ends to said creel arm and at its other end to said first stationary horizontal axis, said swinging bar being pivotable about said axis to pivot said creel arm through a circular arc about said axis; and a plurality of bobbin pins attached to said creel arm and protruding radially inward from said creel arm.

8. A creel assembly comprising:

a first stationary horizontal axis for mounting above a yarn processing machine;

a support framework for supporting said stationary axis above the yarn processing machine;

a creel arm assembly suspended from said axis, said creel arm assembly being configured for carrying a plurality of yarn packages and being pivotable through a circular arc about said axis;

yarn guide means disposed adjacent said axis for guiding yarn from said yarn packages to said yarn processing machine; and counterbalancing means for resiliently holding said creel arm assembly at each of the terminal positions of said arc, including a counterbalancing overcenter linkage.

9. The creel assembly of claim 8, wherein said counterbalancing means comprises:

a pivotable rocker;

an overcenter linkage attached to said creel arm assembly at a first hinge point and to said rocker at a second hinge point, said overcenter linkage being configured so as to locate said first hinge point to one side of a line drawn between said second hinge point and the pivot of said arc when said creel arm assembly is at one of said terminal arc positions and to locate said first hinge point on the other side of said line when said creel arm assembly is at the other of said terminal positions;

and spring means attached to said rocker for resiliently opposing pivoting of said rocker by said overcenter linkage.

10. The creel assembly of claim 8, wherein said creel arm assembly comprises:

an arcuate creel arm radially disposed from said first stationary horizontal axis, said arcuate creel arm, including a center of curvature located at said stationary horizontal axis;

a swinging bar connected at one of its ends to said creel arm and at its other end to said first stationary horizontal axis, said swinging bar being pivotable about said axis to pivot said creel arm through a circular arc about said axis; and a plurality of bobbin pins attached to said creel arm and protruding radially inward from said creel arm.

* * * * *